United States Patent [19]

Kasamura et al.

[11] Patent Number: 4,754,301

[45] Date of Patent: Jun. 28, 1988

[54] MULTICOLOR IMAGE FORMING APPARATUS WITH A SHUTTER TO PREVENT MIXTURE OF DEVELOPERS IN PLURAL DEVELOPING DEVICES

[75] Inventors: Toshirou Kasamura, Yokohama; Akiyoshi Kimura, Tokyo; Masashi Ohashi, Tokyo; Yasuyoshi Yamamoto, Tokyo; Takashi Ozawa, Ichikawa; Toshihiko Kusumoto, Tokyo; Tatsuya Shiratori, Yokohama; Nobukazu Sasaki, Tokyo; Michiro Koike, Kawasaki; Atsushi Kubota, Machida, all of Japan

[73] Assignee: Canon Kabushiki Kaisha, Tokyo, Japan

[21] Appl. No.: 931,081

[22] Filed: Nov. 17, 1986

[30] Foreign Application Priority Data

Nov. 18, 1985 [JP] Japan ..... 60-256640

[51] Int. Cl.[4] ..... G03G 15/00; G03G 15/01

[52] U.S. Cl. ..... 355/3 DD; 355/4; 355/14 D

[58] Field of Search ..... 355/3 DD, 3 DR, 4, 14 D; 118/657

[56] References Cited

U.S. PATENT DOCUMENTS

| | | | |
|---|---|---|---|
| 3,570,453 | 3/1971 | Nuzum | 118/657 |
| 4,077,358 | 3/1978 | Kito | 355/4 |
| 4,336,994 | 6/1982 | Banton | 355/4 |
| 4,460,267 | 6/1984 | Ogawa | 355/3 DD |

FOREIGN PATENT DOCUMENTS

| | | | |
|---|---|---|---|
| 124734 | 9/1979 | Japan | 355/3 DD |
| 101562 | 6/1985 | Japan | 355/4 |
| 168174 | 8/1985 | Japan | 355/3 DD |
| 254065 | 12/1985 | Japan | 355/14 D |

*Primary Examiner*—A. T. Grimley
*Assistant Examiner*—Ed Pipala
*Attorney, Agent, or Firm*—Fitzpatrick, Cella, Harper & Scinto

[57] ABSTRACT

An image forming apparatus includes a plurality of the developing devices for developing the latent image formed on an image bearing member. The plural developing devices are each movable between its developing position for developing the latent image on the image bearing member and its retracted position away from the image bearing member. The image forming apparatus includes a shutter for selectively opening and closing the developing aperture of the developing device of one of the developing devices. The shutter opens and closes the developing aperture of said one of the developing devices in association with movement of the other developing device between the developing position and the retracted position.

10 Claims, 3 Drawing Sheets

MULTICOLOR IMAGE FORMING APPARATUS WITH A SHUTTER TO PREVENT MIXTURE OF DEVELOPERS IN PLURAL DEVELOPING DEVICES

FIELD OF THE INVENTION AND RELATED ART

The present invention relates to an image forming apparatus such as an electric photographic copying apparatus, a laser beam printer and an electrostatic printing apparatus, more particularly to an image forming apparatus comprising a plurality of developing devices which contain different color developers. The present invention is applicable to a multi-color image forming apparatus capable of forming images in two or more different colors, but it is also applicable to a so-called full-color image forming apparatus. The present invention is not limited to the case where the developing devices contain different color developers, but it is also applicable to the case where the contained developers are different, for example, in the polarity of the electric charge of the developers, more particularly, the developing devices contain the respective developers which are electrically charged to different polarities, wherein a positive or negative latent image can be developed by selecting the developing devices.

Recently, the demand for the color copying and color printing has increased in the field of general office work as well as in a special field, and therefore, a color image forming apparatus is desired which can be operated not only by an expert operator but also by an ordinary person. It is often required that an original containing two or more color images, or full-color a original, is reproduced or printed in a desired color or colors. In the full-color image forming apparatus as well as in the multi-color image forming apparatus, it is required to meet the demand to efficiently produce the images in two or three colors.

To satisfy those requirements, the image forming apparatus comprises a plurality of developing devices, and each of the developing devices contains the respective developers which are different in color. For example, a two color image forming apparatus comprises one developing device for black developer which can provide the most frequently used black image and one developing device for red, blue or green images. This is a typical arrangement in the case of a two color image forming apparatus.

FIG. 3 illustrates a conventional color electrophotographic copying apparatus capable of providing two color images, for example, black and red images.

The color electrophotographic copying apparatus has the general construction wherein a photosensitive drum 1, having an electrophotographic photosensitive layer, is disposed generally at the center of the copying apparatus and is detachably and rotatably supported on an unshown shaft having a rotational axis O in a known manner. The photosensitive drum 1, in this example, is rotatable in the clockwise direction in FIG. 3, that is, the direction of an arrow X. The apparatus further comprises around the photosensitive drum 1, a primary charger 2 substantially right above the photosensitive drum 1, a multi-color developing device 3 at the right side of the photosensitive drum 1 in FIG. 3, an image transfer charger 8 substantially right below the photosensitive drum 1 and a cleaning device 9 at the left side of the photosensitive drum 1 in FIG. 3. In the upper portion of the electrophotographic copying apparatus, there is an optical system (not shown), which is effective to project a light image of the original (light signals in accordance with an image to be recorded in the case of a laser beam printer or the like) onto the photosensitive drum 1 at the image exposure station 6 disposed between the primary charger 2 and the multi-color developing apparatus 3, so as to form an electrostatic latent image on the photosensitive drum 1. The latent image thus formed is developed by a developing device, and the developed image is transferred onto a sheet by a transfer charger 8. After the image transfer, the image is fixed by an unshown image fixing device.

The multi-color developing device 3 includes two developing devices 4 and 5 so as to provide a black developed image and a red developed image. Due to the above described arrangement of the copying apparatus (FIG. 3), in most cases, the developing device 5 disposed downstream with respect to the direction of movement of the surface of the photosensitive drum 1 is disposed below the upstream developing device 4 with respect to the direction of the gravity. In the copying apparatus having the structures described above, as shown in FIG. 4, when the upstream developing device 4 is in operation, the developer (toner) T released from the surface of the developing sleeve 4*a* of the developing device 4 can reach the downstream developing device 5 under the influence of gravity and with the aid of the flow of the air produced by the rotation of the photosensitive drum 1. As a result, the developer is mixed with the different developer on the developing sleeve 5*a* of the downstream developing device 5. If this occurs, the image developed by the downstream developing device 5 may have a color which is different from the intended color.

Furthermore, when the rotational direction of the developing sleeve 4*a* of the upstream developing device 4 is such that the direction of the peripheral movement is the same as that of the photosensitive drum 1, the toner T on the developing sleeve 4*a* is easily scattered to the downstream developing device 5 under the influence of the inertia force provided by the rotation of the developing sleeve 4*a*.

Additionally, in the copying apparatus described above, it is not necessary that the developing devices 4 and 5 contain different color developers. Generally, however, they contain different color developers, for example, black and red developers, and the developing device containing the developer having the color selected by an operator on an operation panel is shifted toward a predetermined developing position adjacent to the photosensitive drum 1, whereby the latent image can be developed by the selected color developer. Therefore, when one of the developers is shifted to the predetermined developing position, vibration or shock can occur with the result of the developer falling or scattering from the developing device to enter the other developing device. This, of course, leads to mixture of color.

SUMMARY OF THE INVENTION

Accordingly, it is a principal object of the present invention to provide an image forming apparatus wherein an image without color mixture, that is, an image in the intended color can be produced.

It is another object of the present invention to provide an image forming apparatus comprising a plurality of developing devices, wherein the developer scattering from one of the developing devices is prevented from entering the other developing device, by a simple structure.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

An image forming apparatus according to an embodiment of the present invention will be described in conjunction with the drawings.

Figure 3:
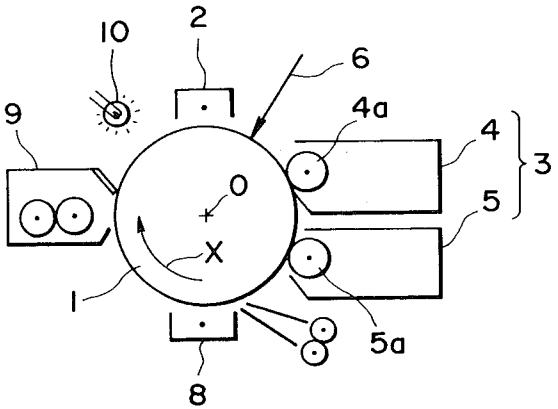
FIG. 3 is a sectional view of two color image forming apparatus to which the present invention is applicable.

FIG. 3 illustrates a part of a two color electrophotographic copying apparatus to which the present invention is applicable.

Figure 1:
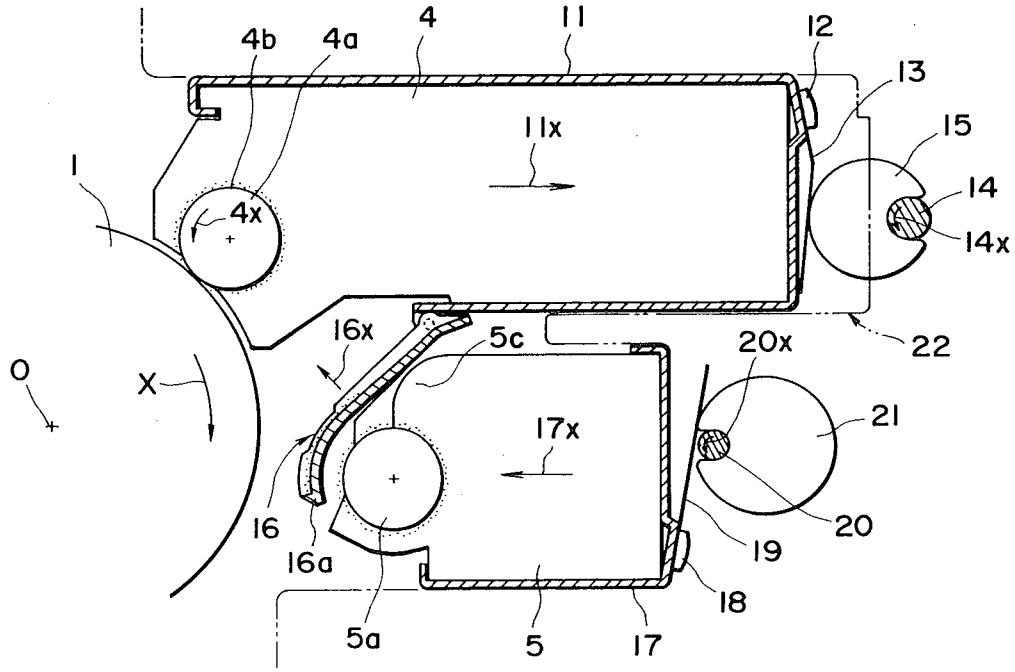
FIG. 1 is a sectional view of a developing device of an image forming apparatus according to an embodiment of the present invention, wherein a red developing device is at the developing position.
Figure 2:
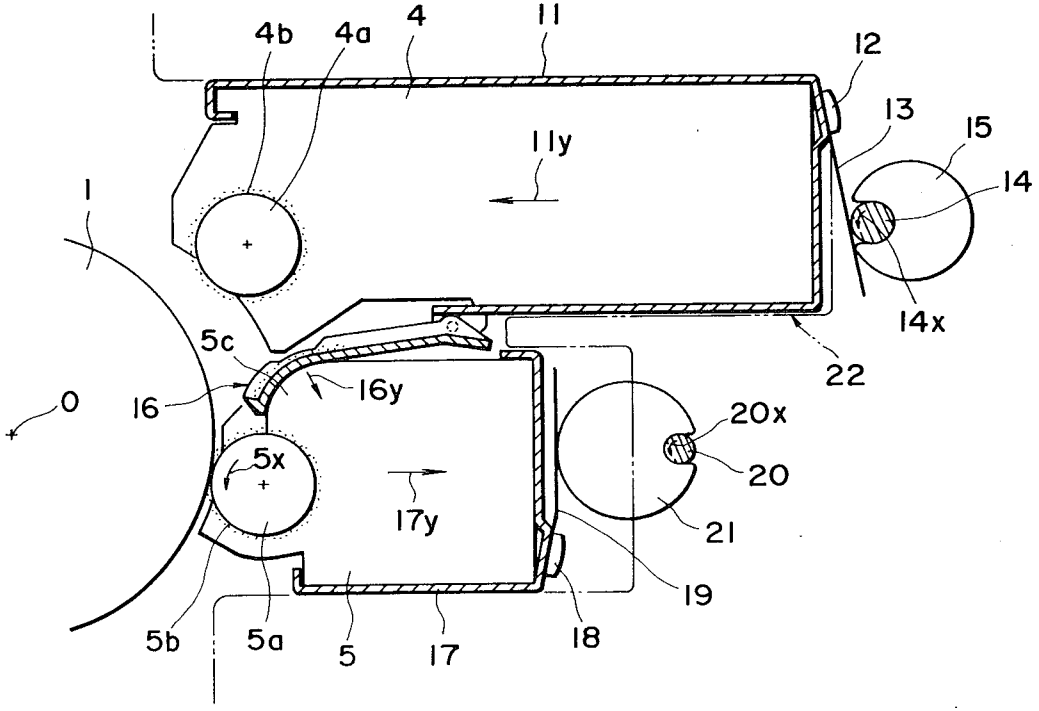
FIG. 2 is a sectional view of the same part, wherein, however, a black developing device is at the developing position.
Figure 4:
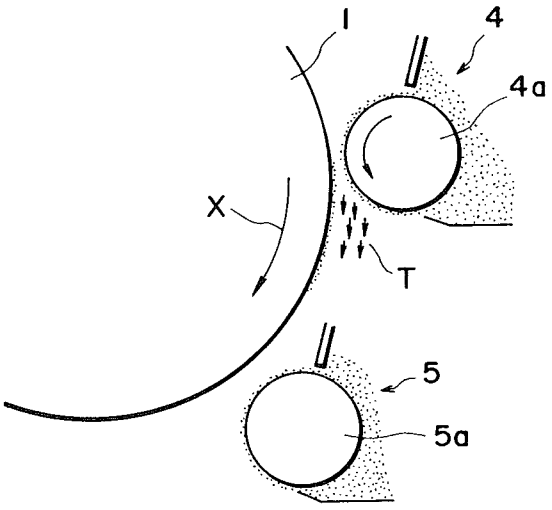
FIG. 4 is a sectional view illustrating the developer scattering from the developing device due to rotation of a developing sleeve.

Referring to FIGS. 1 and 2, there is shown a multicolor developing device 3 of the color image forming apparatus. As shown in FIG. 3, the photosensitive drum 1 is disposed substantially at the center of the copying apparatus and is rotatable about a rotational axis O in the rotational direction indicated by an arrow X. Around the photosensitive drum 1, there are disposed various elements for effecting the electrophotographic process.

In this embodiment, a black color developing device 5 is disposed at a lower position and is detachably mounted to a black color developing device supporting member 17 movably mounted in the frame 22 of the apparatus. The developing device 5 contains the black developer (not shown) and is provided with a developing roller (or sleeve) 5*a* rotatably supported with a part thereof exposed through a developing aperture to supply the developer to the photosensitive drum 1. The developing roller 5*a*, as is well known, includes a sleeve (not shown) of non-magnetic material containing therein a magnet.

A pressing spring 19 is fixed by screws 18 to a rear wall of the black developing device supporting member 17. A pressing, cam 21 is rotatable about a shaft 20 and engages spring 19.

By rotation of the pressing cam 21, the black developing device 5 is movable between a developing position for developing the latent image on the photosensitive drum 1 and a retracted position sufficiently away from the photosensitive drum 1. In this embodiment, the black developing device 5 is made non-operative when it is situated at its retracted position.

A red color developing device 4 disposed above the black developing device 5 has similar structures. More particularly, the red developing device 4 is detachably mounted to a red developing device supporting member 11 which is movably mounted to the frame 22 of the apparatus. The red developing device 4, as is well known, contains a red developer (not shown) and is provided with a developing roller (sleeve) 4*a* with a part thereof exposed through a developing aperture to supply developer to the photosensitive drum 1. The developing roller 4*a* includes a sleeve (not shown) of non-magnetic material and a magnet contained therein.

A pressing spring 13 is fixed by screws 12 to a rear wall of the supporting member 11. A pressing cam 15 is rotatable about a shaft 14*a* and engages spring 13.

By the rotation of the pressing cam 15, the red developing device 4 is movable between a developing position for developing the latent image on the photosensitive drum 1 and a retracted position which is sufficiently away from the photosensitive drum 1. In this embodiment, the red developing device 4 is made inoperative when situated in its retracted position.

According to this embodiment of the present invention, a shutter is swingably supported adjacent an end of the red developing device supporting member 11 so as to prevent the unintended developer from entering the developing device 5. The shutter 16 has one end in the neighborhood of which it is rotatably supported to the supporting member 11, and a free end 16*a* in the neighborhood of which it is effective to cover the portion of the developing roller 5*a* of the black developing device 5 which is exposed to the photosensitive drum 1 through the developing aperture.

FIG. 1 shows the state wherein the image is developed by red developer, more particularly, the red developing device 4 is disposed close to the photosensitive drum 1 (developing position), while the black developing device 5 is away from the photosensitive drum 1 retracted position). This position is achieved by a control signal provided from the operation panel, which signal presses the red developing device 4 by the pressing cam 15 through the pressing spring 13.

In this state, the developing device 4*a* rotates in the direction of 4X to supply red developer 4*b* to the photosensitive drum 1 so as to develop the latent image on the photosensitive drum 1 in red.

At this time, the black developing device 5 is released from the pressing cam 21, and therefore, it is urged by an unshown urging means such as a spring (not shown) mounted to a frame 22, so that it is moved in the direction 17*y* and is maintained at its retracted position sufficiently away from the photosensitive drum 1.

The shutter 16 rotatably supported on the red developing device supporting member 11 adjacent its one end is moved to the photosensitive drum 1 along a cam surface 5*c* formed in a frame of the black developing device 5, while the red developing device 4 moved from the retracted position toward the photosensitive drum 1. During this movement, the free end 16*a* comes to cover the exposed portion of the developing roller 5*a* of the black developing device with the aid of gravity (an arrow 16*y*). As a result, the shutter 16 is interposed between the photosensitive drum 1 and the developing roller 5*a* of the black developing device 5. By this, the red developer scattering and falling from the red developing device 4 is prevented from attaching to the developing roller 5*a* of the developing device 5, so that the mixture of the developers is prevented.

When, on the other hand, the black image is to be provided, the shaft 14 of the pressing cam 15 rotates in the direction of an arrow 14X from the state shown in FIG. 1 by a signal given from the operation panel so as to release the pressure to the red developing device 4. Therefore, the red developing device 4 moves in the direction of an arrow 11X (FIG. 1) by an unshown urging means such as a spring mounted to the frame 22 of the apparatus, with the result that it is moved to a retracted position which is sufficiently away from the photosensitive drum 1 as shown in FIG. 2. Simultaneously, the shutter 16 swings in the direction of an arrow 16X (FIG. 1) by the cam surface 5*c* formed on a part of the black developing device 5.

The black developing device 5 starts moving in the direction of an arrow 17X, that is, toward the photosensitive drum 1 by the rotation of the pressing cam 21 about the shaft 20 in the direction of an arrow 20X. Together with the movement, the shutter 16 is moved in the direction of an arrow 16X by the cam surface 5*c* formed on the frame of the black developing device 5. The developing device 5 is moved to the developing position. It is not always necessary that the cam surface 5*c* is integral with the developing device 5, but may be provided on the frame of the copying apparatus. The shutter 16 may be made swingable in the directions 16X and 16Y by means other than the cam surface 5*c*.

FIG. 2 illustrates the situation wherein the black image is to be provided. The black developing device 5 is pressed toward the photosensitive drum 1 through the pressing spring 19 by the pressing cam 21 fixed to the shaft 20, thus taking the developing position wherein it is capable of developing the latent image on the photosensitive drum 1. The developing roller 5*a* rotates in the direction shown by an arrow 5X so as to supply the black developer 5*b* to the photosensitive drum 1, thus developing the latent image on the photosensitive drum 1 in black.

At this time, the shutter 16 is between the red developing device 4 and the black developing device 5, and does not cover the developing roller 5*a* of the black developing device 5, so that the shutter 16 does not obstruct the developing operation of the black developing device.

In the foregoing embodiment, the shutter 16 is supported on the developing device supporting member of that one of the developing devices which is located upstream with respect to the rotation of the image bearing member. However, this is not limiting, but the shutter may be supported on the developing device to be covered or supported on the frame of the apparatus. What is required is that a developing aperture of the developing device is opened or closed in association with movement of the other developer.

In the embodiment, the developing device is urged by urging means such as a spring in the direction away from the photosensitive drum, and the developing device is moved to the developing position by the rotation of the pressing cam against the urging force of the spring, while the developing device is moved back to the retracted position by releasing the developing device from the pressure of the pressing cam. However, another arrangement is possible, for example, a controllable solenoid or plunger may be used to shift the developing devices.

In the two color image forming apparatus shown in FIG. 3 to which the present invention is applicable, a latent image to be reproduced as a red image is formed and then developed, and the developed image is transferred onto a transfer sheet; and then a latent image to be developed in black is formed and developed, and then the developed black image is transferred onto the same sheet (having the red image). That is, the image transfer operation is effected twice. However, the latent images corresponding to the red image and the black image, respectively is formed in a single image forming cycle, and then they are developed by the respective color developers, and subsequently the developed images are transferred onto the transfer sheet simultaneously.

The present invention is not limited to the copying apparatus having only two applicable devices, but is to the image forming apparatus having three or more developing devices.

As described in the foregoing, according to the present invention, a developing aperture of one of the developing devices is closed or opened in association with movement of the other developing device, by which the possibility of the mixture of the developers by the scattering or falling thereof, can be prevented by a simple structure, thus providing stabilized and high quality images.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming a latent image on a surface of said image bearing member in accordance with image information;

at least first and second developing means disposed along the surface of said said image bearing member each for developing a latent image formed on said image bearing member by said latent image forming means, each of said first and second developing means being selectively movable between a developing position for developing the latent image on said image bearing member and a retracted position away from said image bearing member, wherein said second developing means is disposed downstream of said first developing means with respect to a movement direction of the surface of said image bearing member; and a shutter for selectively closing and opening a developing aperture of said second developing means, said shutter being supported on means for supporting said first developing means and effective to selectively open and close the developing aperture in association with movement of said first developing means between said developing position and said retracted position.

2. An apparatus according to claim 1, wherein said shutter closes the developing opening of said second developing means in association with the movement of said first developing means from the retracted position to the developing position, and wherein said shutter opens the developing aperture of said second developing means in association with the movement of said first developing means from the developing position to the retracted position.

3. An apparatus according to claim 2, wherein when said first developing means is at said developing position, said second developing means is at the retracted position.

4. An apparatus according to claim 2, wherein when said first developing means is at the retracted position, said second developing means is at the developing position.

5. An apparatus according to claim 3 or 4, wherein together with the movement of said first developing means between the developing position and the retracted position, said second developing means is inversely moved between the retracted position and the developing position.

6. An apparatus according to claim 1, wherein said first developing means and said second developing means contain developers which are different in color.

7. An apparatus according to claim 1, wherein said second developing means includes at the developing aperture a developing roller for carrying thereon the developer to supply it to said image bearing member.

8. An apparatus according to claim 1, wherein said shutter is guided by a frame of said second developing means when it moves.

9. An image forming apaparatus, comprising:

a movable image bearing member;

means for forming a latent image on a surface of said image bearing member in accordance with image information;

at least first and second developing means each disposed along the surface of said image bearing member for developing a latent image formed on said image bearing member by said latent image forming means, each of said first and second developing means being selectively movable between a developing position for developing the latent image on said image bearing member and a retracted position away from said image bearing member wherein said second developing means is disposed downstream of said first developing means with respect to a movement direction of the surface of said image bearing member;

a shutter for selectively closing and opening a developing aperture of said second developing means; and control means for controlling the positions of said first and second developing means relative to said image bearing member so that when one of said first and second developing means is moved to its developing position, the other is moved to its retracted position, wherein said control means includes a member which is separate from said second developing means and said image bearing member, is disposed between said first and second developing means and is movable together with said first developing means, said member movably supporting said shutter for said second developing means.

10. An image forming apparatus, comprising:

a movable image bearing member;

means for forming a latent image on a surface of said image bearing member in accordance with image information;

at least first and second developing means each disposed along the surface of said image bearing member for developing a latent image formed on said image bearing member by said latent image forming means, each of said first and second developing means being selectively movable between a developing position for developing the latent image on said image bearing member and a retracted position wherein it is away from said image bearing member, wherein said second developing means is disposed downstream of said first developing means with respect to a movement direction of the surface of said image bearing member;

a shutter for selectively closing and opening a developing aperture of said second developing means, said shutter being movable between a retracted position located between said first developing means and said second developing means and an operative position for closing the developing aperture; and means for moving said first developing means to its retracted position, while moving said shutter to its retracted position when said second developing means is moved to its developing position.

* * * * *

UNITED STATES PATENT AND TRADEMARK OFFICE

CERTIFICATE OF CORRECTION

PATENT NO. : 4,754,301

DATED : June 28, 1988

INVENTOR(S) : TOSHIROU KASAMURA, ET AL.

It is certified that error appears in the above-identified patent and that said Letters Patent is hereby corrected as shown below:

COLUMN 1

Line 10, "electric photographic" should read --electrophotographic--.
Line 34, "full-color a" should read --a full-color--.

COLUMN 3

Line 56, "pressing," should read --pressing--.

COLUMN 4

Line 20, "shutter" should read --shutter 16--.
Line 35, "retracted" should read --(retracted--.
Line 53, "moved" should read --is moved--.

COLUMN 5

Line 50, "developer." should read --developing device.--.

UNITED STATES PATENT AND TRADEMARK OFFICE

CERTIFICATE OF CORRECTION

PATENT NO. : 4,754,301

DATED : June 28, 1988

INVENTOR(S) : TOSHIROU KASAMURA, ET AL.

It is certified that error appears in the above-identified patent and that said Letters Patent is hereby corrected as shown below:

COLUMN 6

Line 10, "applicable" should read --developing-- and "is to" should read --is applicable to--.
Line 34, "said said" should read --said--.
Line 55, "opening" should read --aperture--.

Signed and Sealed this

Fourteenth Day of November, 1989

*Attest:*

JEFFREY M. SAMUELS

*Attesting Officer* *Acting Commissioner of Patents and Trademarks*